US006475051B1

(12) United States Patent
Griffin et al.

(10) Patent No.: US 6,475,051 B1
(45) Date of Patent: Nov. 5, 2002

(54) CHILD'S TOY

(76) Inventors: Mary L. Griffin, 4244 FM 2231 West, Breckenridge, TX (US) 76424; Kellie F. Garland, 5920 Hempstead Dr., Plano, TX (US) 75093

( * ) Notice: Subject to any disclaimer, the term of this patent is extended or adjusted under 35 U.S.C. 154(b) by 0 days.

(21) Appl. No.: 10/026,581

(22) Filed: Dec. 18, 2001

(51) Int. Cl.[7] ..... A63H 33/00
(52) U.S. Cl. ..... 446/26; 446/901; 36/112
(58) Field of Search ..... 446/26, 901; 2/911–912, 2/919, 239, 245, 247; 36/136, 132, 112; D2/899, 952, 981, 982

(56) References Cited

U.S. PATENT DOCUMENTS

| | | | | | |
|---|---|---|---|---|---|
| D189,082 | S | | 10/1960 | Goodman | D7/7 |
| 3,017,640 | A | | 1/1962 | Cardwell et al. | 2/239 |
| 3,023,420 | A | | 3/1962 | Tann | 2/239 |
| 3,226,849 | A | | 1/1966 | Rosen | 36/1 |
| 3,402,485 | A | | 9/1968 | McMorrow | 36/25 |
| D224,183 | S | | 7/1972 | Straub et al. | D2/4 |
| D224,184 | S | | 7/1972 | Straub et al. | D2/4 |
| 3,936,896 | A | | 2/1976 | Creamer | 9/310 |
| D251,080 | S | | 2/1979 | Koblick | D34/14 |
| 4,304,065 | A | | 12/1981 | Baiera | 46/154 |
| 4,950,196 | A | | 8/1990 | Fortune et al. | 446/73 |
| 5,003,637 | A | | 4/1991 | Lonon | 2/160 |
| 5,058,293 | A | | 10/1991 | Villar | 36/136 |
| 5,117,507 | A | | 6/1992 | Long | 2/158 |
| 5,325,545 | A | | 7/1994 | Hirano | 2/239 |
| D362,109 | S | * | 9/1995 | Jones | D2/962 |
| D378,108 | S | | 2/1997 | Shippy | D21/189 |
| D378,869 | S | | 4/1997 | Mikell | D2/615 |
| D381,493 | S | | 7/1997 | Comeau | D2/906 |
| 5,643,037 | A | | 7/1997 | Altschul | 446/28 |
| 5,699,557 | A | * | 12/1997 | Johnson | 2/239 |
| 5,979,085 | A | * | 11/1999 | Ross et al. | 36/136 |
| D423,605 | S | | 4/2000 | Graves | D21/483 |
| 6,080,033 | A | * | 6/2000 | Fladwood et al. | 446/26 |

* cited by examiner

*Primary Examiner*—Derris H. Banks
*Assistant Examiner*—Jamila Williams
(74) *Attorney, Agent, or Firm*—The Halvorson Law Firm

(57) ABSTRACT

Described is a child's toy that is useful for assisting a child in imaginative play. The toy of the present invention has two primary embodiments: a sock mounted embodiment and a shoe mounted embodiment. The sock-mounted embodiment comprises a sock and a sock-attachable foot. The shoe-mounted embodiment comprises a shoe harness and a shoe attachable foot. The sock (or shoe) attachable foot is preferably an animal foot (most preferably a pair of feet). Preferably, the sock attachable foot is a replication of a complete foot, but may only be a replication of a top portion of a foot section. The bottom of each sock-attachable foot is designed to attach to a topside of a sock or shoe-attachment harness to be worn, or is simultaneously worn, by a child. There are several preferred sock mounted foot designs, among which are duck's feet, dinosaur feet, monkey feet, chicken feet, monster feet, and the like.

10 Claims, 7 Drawing Sheets

CHILD'S TOY

FIELD OF THE INVENTION

The present invention relates to the field of childrens toys. More specifically, the present invention relates to the field of wearable toys that assist a child in imaginative play.

BACKGROUND

Children love to play. Children especially love to use their imagination when they play. In many instances, a child's imagination is all that is required for the child to engage in imaginative play. However, it is sometimes fun for the child, especially when playing with other children (or adults), to use props to assist in the imaginative play. This is usually done with hand-held devices, toys, sticks or the like. It is seldom that the prop is a foot mounted/used device. This is probably due to the relative dearth of foot used/mounted toys.

The prior art clearly shows that foot mounted/used toys exist and when they exist, they are animal or puppet themed. Some interesting examples of wearable animal foot type devices are illustrated in design patents: Des. U.S. Pat. No. 189,082 (a slipper); Des. U.S. Pat. No. 224,183 (a boot); Des. U.S. Pat. No. 224,184 (a boot); and utility patents: U.S. Pat. No. 3,936,896 (a shoe for walking in water) and U.S. Pat. No. 5,058,293 (an animated shoe with moveable facial features). In these examples, the devices are worn on the entire foot or hand. While fun and imaginative, the boot must be removed in its entirety in order to change animal type. Moreover, because each animal type requires a whole boot considerable storage space is required when the toys are not in use. Further, multiple copies must be on hand to satisfy different foot size requirements.

Other types of devices that are worn are found illustrated in design patent Des. U.S. Pat. No. 378,869 (a glove), and utility patents: U.S. Pat. No. 4,304,065 (a walking hand puppet); U.S. Pat. No. 4,950,196 (a hand puppet attached to a basket); and U.S. Pat. No. 5,117,507 (a hand puppet attached to a sleeve of a jacket). While fun and imaginative, these types of devices only use a small portion of the child's body (the hand) for the imaginative play, thereby not allowing the child to utilize his/her entire body and, as discussed above, different sizes of glove puppets would be required to accommodate the differences in hand sizes found in children. Feet are not immune to the lure of puppetry, as is illustrated in utility patents: U.S. Pat. No. 3,017,640 (a sock with ornamental design); U.S. Pat. No. 3,023,420 (a sock puppet); and U.S. Pat. No. 5,325,545 (a sock puppet). However, sock puppets suffer all the same deficiencies as are found in hand puppets and wearable boots.

One way to address the problem of different foot sizes is to create a shoe mounted device. Some interesting examples of shoe mounted animal foot type devices are illustrated in design patents: Des. U.S. Pat. No. 251,080 (a hominid foot print); Des. U.S. Pat. No. 381,493 (a three-toes clawed animal foot print); and Des. U.S. Pat. No. 423,605 (a three-toes animal foot print), and utility patents U.S. Pat. No. 5,643,037 and U.S. Pat. No. 3,402,485 (a footprint generating shoe sole). In these examples the toy is mounted on the bottom of the wearer's shoe or foot and create an animal-like foot print. While fun and imaginative, these devices are larger than the wearer's natural foot. Small children (and some adults), who are learning coordination skills, have problems walking or running while wearing an oversized footprint device. Moreover, since these devices are primarily for generating footprints, they are relatively useless when used inside or on surface that do not readily take imprints.

There are even devices (toys) that are worn on both hands and feet, such as utility patent U.S. Pat. No. 5,643,037 (a full body puppet-type toy). As described above, this toy would require considerable storage space and several different sizes to accommodate differently sized children.

It can be clearly seen that there is a need for children's toys that assist the child in imaginative play, especially toys that are interchangeable as to the children and/or imaginative aspect. Moreover, there is a need for such toys that do not take up an inordinate amount of storage space when not used.

SUMMARY OF INVENTION

It is an object of the present invention to provide a child's toy that assists the child in imaginative play and that further allows the child to use his/her entire body in the imaginative play.

It is another object of the present invention to provide a child's toy that is interchangeable as to the child using the toy, especially interchangeable by the child.

It is yet another object of the present invention to provide a child's toy that is interchangeable as to the imaginative aspect of the toy without having to remove an entire shoe, sock or glove.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. § 112, paragraph 6 to define the invention. To the contrary, if the provisions of 35 U.S.C. § 112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION OF PREFERRED EMBODIMENTS

Figure 1:
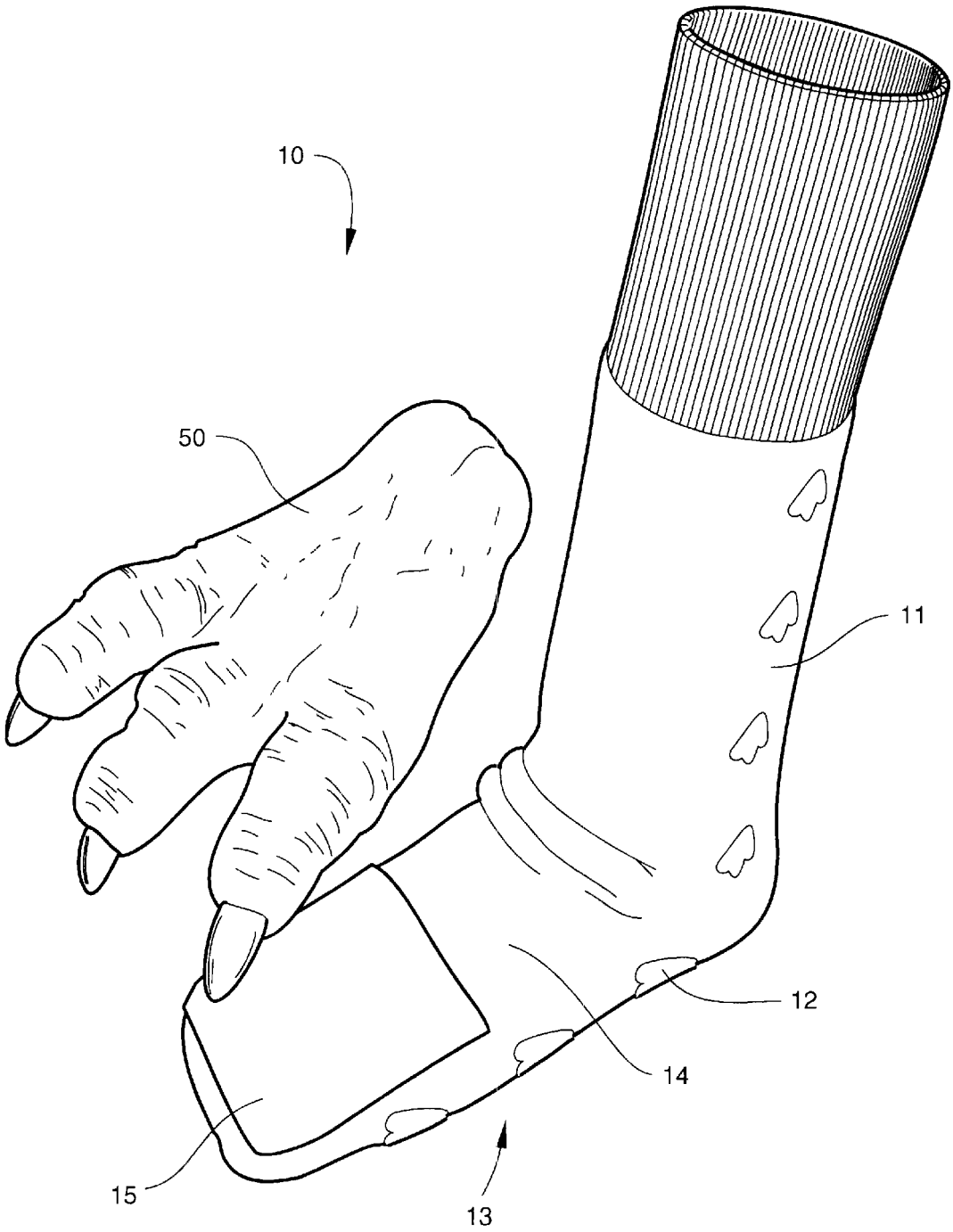
FIG. 1 is an one embodiment of the present invention.
Figure 2:
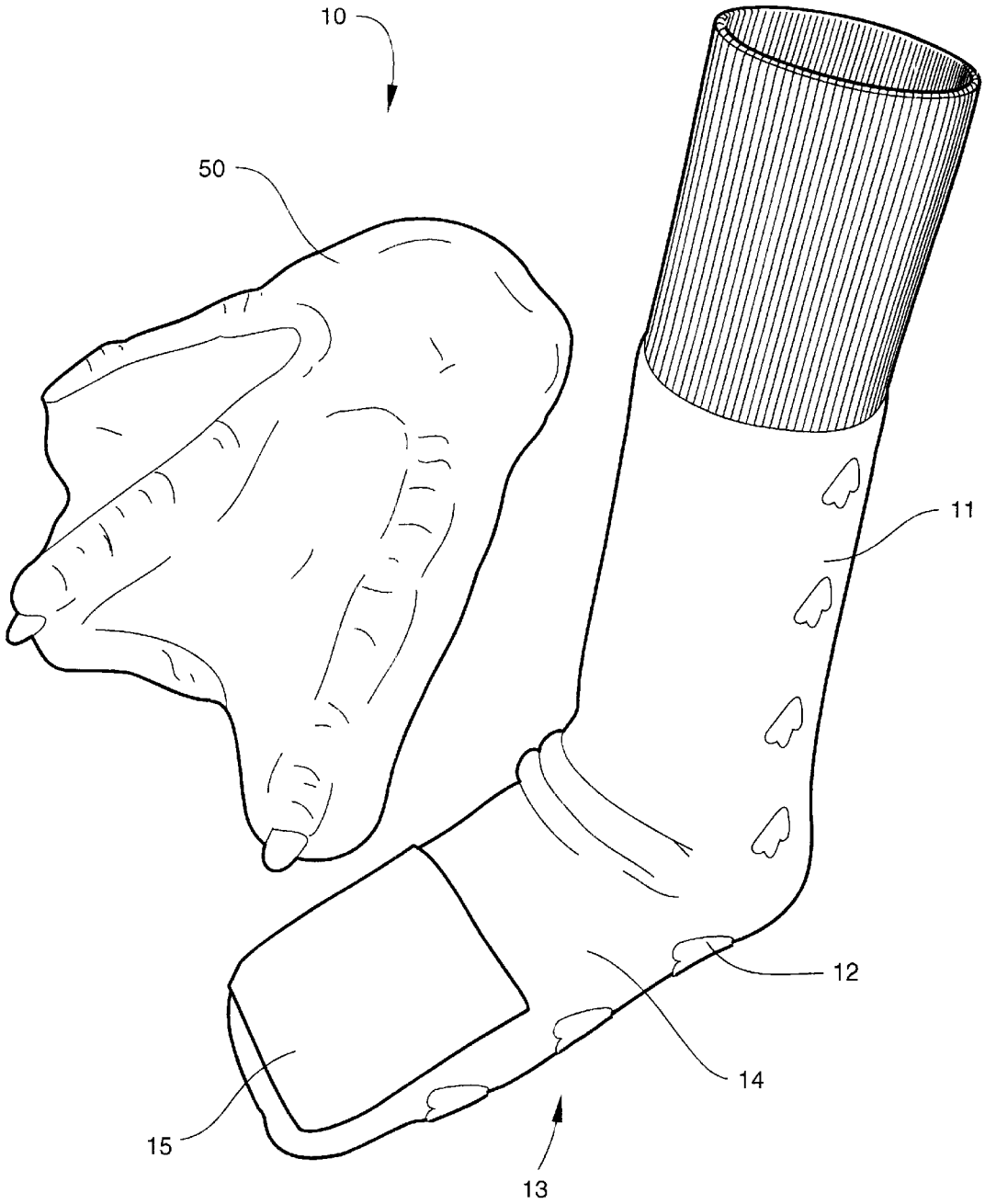
FIG. 2 is a second embodiment of the present invention.
Figure 3:
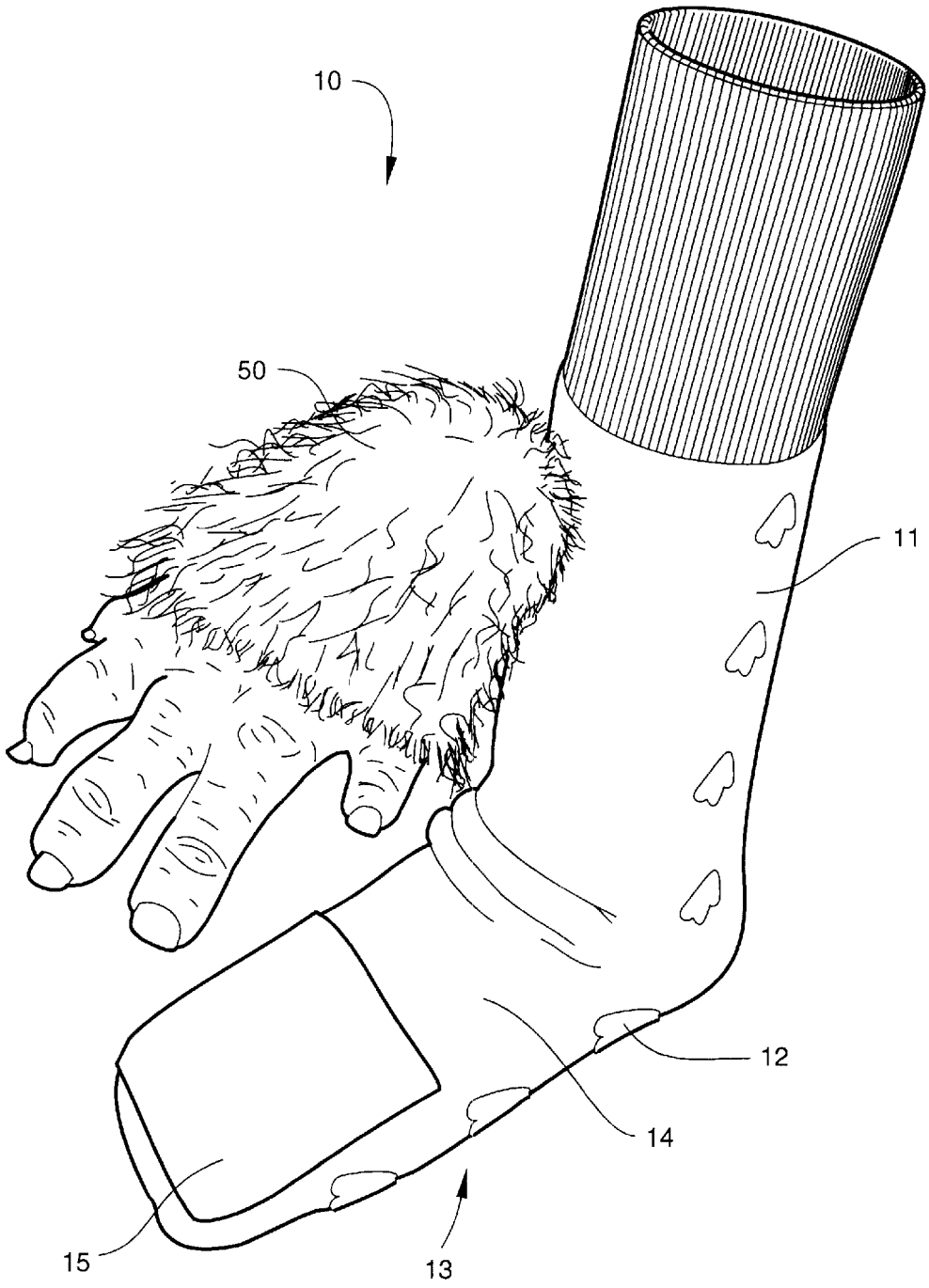
FIG. 3 is a third embodiment of the present invention.
Figure 4:
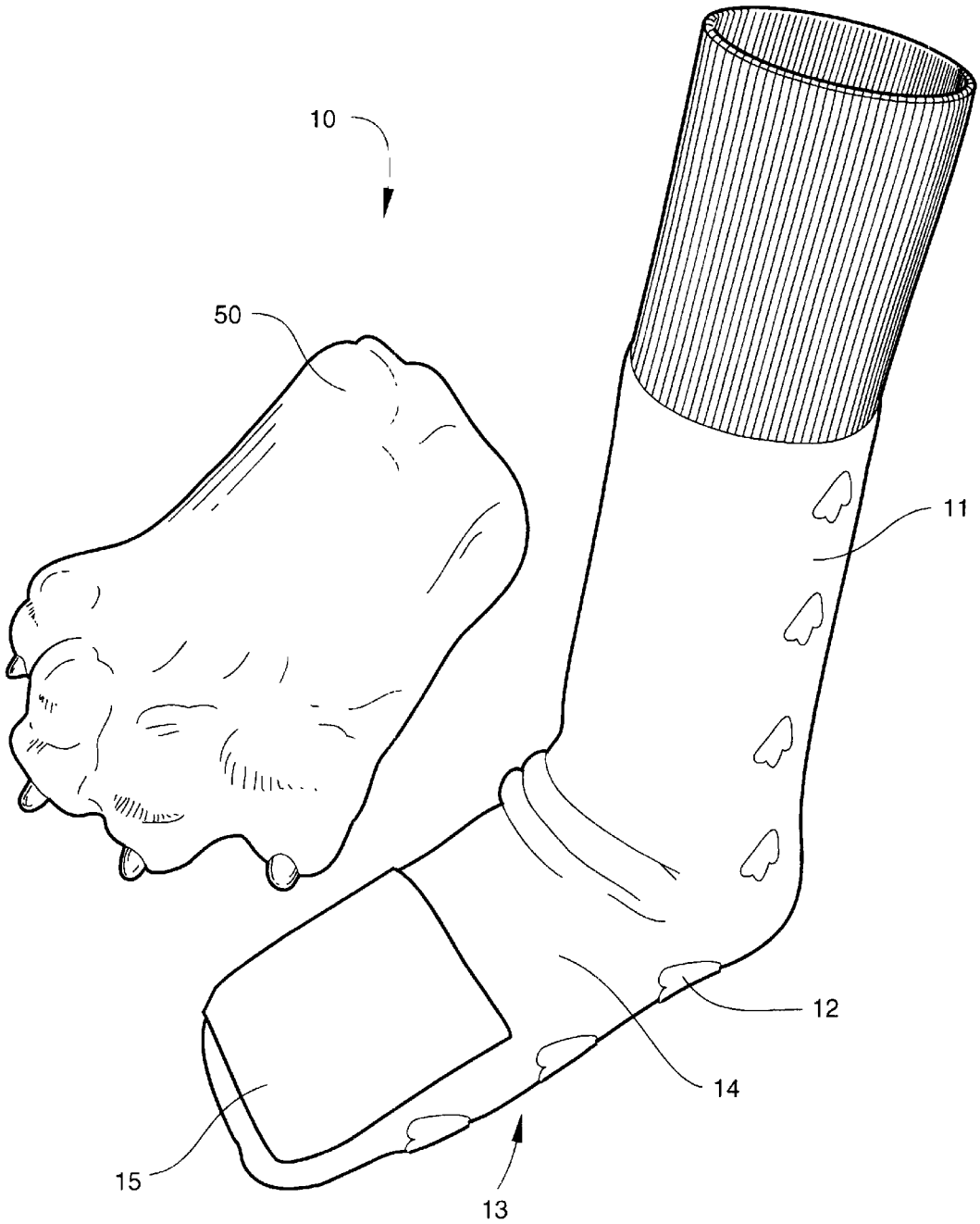
FIG. 4 is a fourth embodiment of the present invention.
Figure 5:
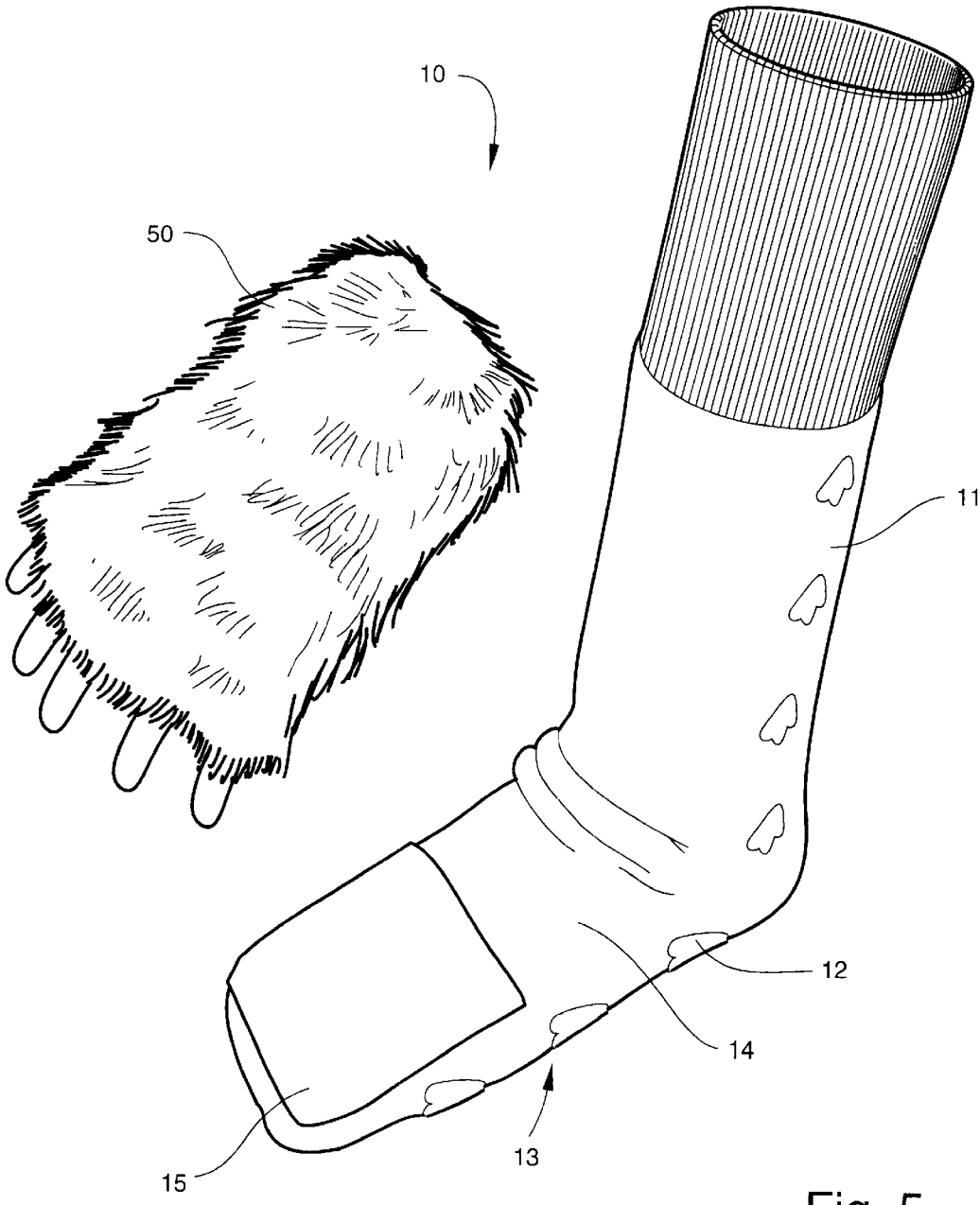
FIG. 5 is a fifth embodiment of the present invention.

The present invention is a child's toy 1 that is useful for assisting a child in imaginative play. The toy 1 of the present invention has two primary embodiments: a sock-mounted embodiment 10 and a shoe-mounted embodiment 20. A glove-mounted embodiment is also considered to fall within the scope of the present invention, but is not further described or illustrated herein.

The sock-mounted embodiment 10 comprises a sock 11 and a sock-attachable foot 50.

The sock 11 use with the present invention may be an ordinary type sock, as are commonly used by children, but may be a sock with bottom mounted traction elements 12 (as illustrated in the figures). The choice of the type of sock 11 may be left to the parent of the child or may be determined at the time of toy manufacture and provided as a kit (socks included). The sock 11 has a bottom side 13 and topside 14. The topside 14 of the sock 11 has a structure 15 that allows for the easy and removable attachment of the sock-attachable foot 50, as will be further described below.

The sock-attachable foot 50 is preferably an animal foot (more preferably a pair of feet), whether a real animal, an extinct animal, an imaginative animal, aliens or the like. However, real or imaginative vegetable type feet, such as roots are considered to fall within the scope of the present invention. Preferably, the sock-attachable foot 50 is a body that comprises a replication of a complete foot section (in order to maximize the child's imaginative powers), but may only be a replication of a top portion of a foot section. Each sock-attachable foot 50 has a bottom side 51 that is designed to attach to the topside 14 of the sock 11 to be worn, or is simultaneously worn, by a child. There are several preferred sock-mounted foot 50 designs, as illustrated in the accompanying FIGS. 1–5, among which are duck's feet, dinosaur feet, monkey feet, chicken feet, monster feet, and the like. One useful limitation is that the foot replications should not be oversized, but should be approximately the same size as a normal human foot.

Figure 6:
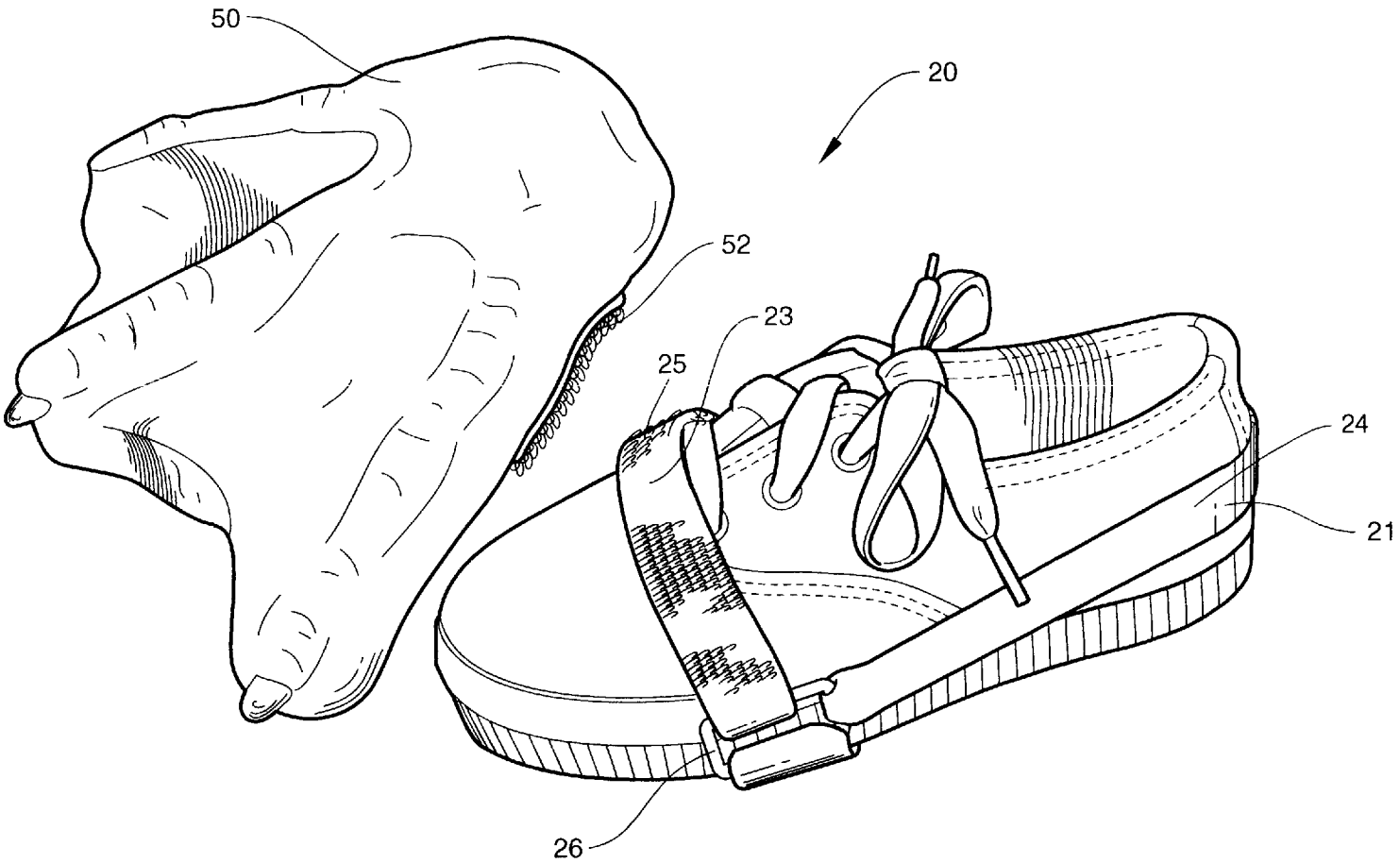
FIG. 6 is a sixth embodiment of the present invention, this embodiment for use with a shoe.
Figure 7:
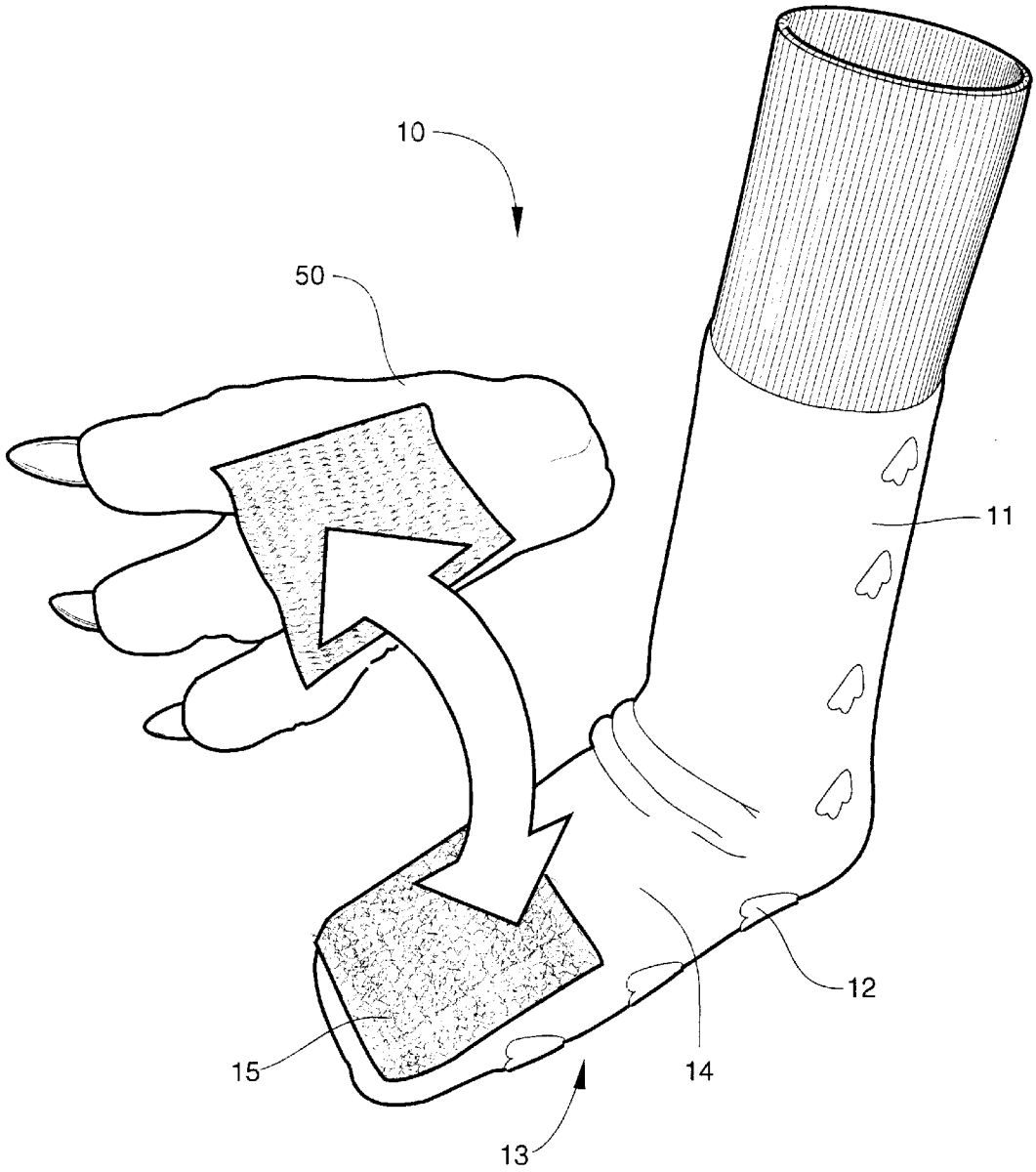
FIG. 7 Illustrates the underside of the sock or show attachable foot.

Like the sock-mounted embodiment 10, the shoe-mounted embodiment 20, illustrated in FIG. 6, has a shoe-attachable foot 50 (more preferably a pair of feet), but further has a shoe-attachment harness 21. The shoe-attachment harness 21 is a series of straps 22 that comfortably and removably fits around, and secures to, a child's shoe. Alternately, this same shoe-attachment harness 21 may be used to without shoes on a child that is either barefooted or wearing unmodified socks. The shoe-attachment harness 21 comprises a vertical strap 23 and a horizontal strap 24, both of which are attached to each other at ring structure 26. The vertical strap 23 fits around a front portion of a shoe worn by a child and preferably attaches to itself by a buckle, hook and loop fasteners or other like structures, while the horizontal strap 24 fits around a back portion of the shoe and preferably attaches to itself by a buckle, hook and loop fasteners or other like structures, thereby providing stability to the toy 1. The shoe-attachment harness 21 further comprises a foot attachment portion 25 on the vertical strap 23, to which the shoe-attachable foot 50 may be easily and removably attached.

For both of the above described embodiments, the attachable feet 50 (both sock and shoe) are easily and removably attached to the sock 11 or shoe-attachment harness 21. Easy and removable attachment is accomplished preferably using a child friendly attachment system, such a hook-and-loop fasteners, where the loop containing section, the structure 15 or foot attachment portion 25 is secured to the sock 11 or shoe-attachment harness 21, respectively, and the hook containing section 52 is secured to the bottom surface 53 of the sock or shoe attachable foot 50. However, other systems for attaching the sock or shoe attachable foot 50 to the sock 11 or shoe harness 21, such as ties, button, snaps, temporary adhesives or the like, are considered to fall within the scope of the present invention. Also, reversing the positioning of the hook-and-loop fasteners is also considered to fall within the scope of the present invention.

While toys that are mounted to the top of shoes are known in the prior art, such as utility patents: U.S. Pat. Nos. 5,058,293 and 5,979,085, they are of the puppet type, which engages only the foot in imaginative play and not the child's entire body, as does the present invention.

In using the present invention, the child will pull on a pair of socks 11 (or will put the shoe-attachment harness 21 on their shoes) that have been modified to receive sock (or shoe) attachable feet 50 and the sock (or shoe) attachable feet 50 are then removably secured to the sock 11 or shoe-attachment harness 21. In the example of a hook-and-loop fastening system, simple pressure is sufficient to easily and removably secure the sock (or shoe) attachable feet 50 to the sock (or shoe harness). Thus, the child, when looking down or being viewed by another child, has the appearance of having different feet, such as that of an animal. This child can then, using his/her imagination, utilize his/her entire body as the remainder of the animal. Additionally, the present toy has the unique capability that the sock (or shoe) attachable feet 50 are quickly and easily changeable or interchangeable. Therefore, when a child tires of pretending to be one type of animal, by changing sock (or shoe) attachable feet 50, the child can pretend to be a different animal, without having to remove his/her shoes or socks. Additionally, due to the interchangeability, the child may wish to change only one sock (or shoe) attachable foot 50, thereby creating a mismatched set of feet 50 for further enjoyable imaginative play (such as one duck foot and one dinosaur foot could allow the child to imagine himself/herself a duckasaurous).

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A toy kit for a child comprising:

a) at least one sock-attachable foot in combination with b) at least one sock modified to removably receive the sock-attachable foot.

2. The toy kit according to claim 1 wherein the at least one sock-attachable foot comprises a body that resembles an foot selected from the group comprising real animal feet, imaginative animal feet, vegetable feet, imaginative vegetable feet, alien feet and monster feet.

3. The toy kit according to claim 1 wherein the at least one modified sock comprises a sock with an attachment structure located on a topside of the sock.

4. The toy kit according to claim 3 wherein the at least one sock-attachable foot further comprises an attachment structure located on a bottom surface of the at least one sock-attachable foot.

5. The toy kit according to claim 4 wherein the at least one sock-attachable foot comprises a body that resembles an foot selected from the group comprising real animal feet, imaginative animal feet, vegetable feet, imaginative vegetable feet, alien feet and monster feet.

6. A toy kit for a child comprising:

a) at least one shoe-attachable foot with a harness attachment structure located on a bottom surface in combination with b) at least one shoe-attachment harness, with a foot attachment structure located on a strap of the shoe attachment harness, which can removably receive the shoe-attachable foot where the foot attachment structure and the harness attachment structure work together to provide the removability of the shoe-attachable foot from the shoe-attachment harness.

7. The toy kit according to claim 6 wherein the at least one shoe-attachable foot comprises a body that resembles an foot selected from the group comprising real animal feet, imaginative animal feet, vegetable feet, imaginative vegetable feet, alien feet and monster feet.

8. The toy kit according to claim 6 wherein the at least one shoe-attachment harness comprises a vertical strap attached by a ring structure to a horizontal strap.

9. The toy kit according to claim 8 wherein the vertical strap of the at least one shoe-attachment harness further comprises the shoe attachment structure.

10. A toy kit for a child comprising:

a) at least one shoe-attachable foot in combination with b) at least one shoe-attachment harness that can removably receive the shoe-attachable foot, wherein the at least one shoe attachment harness comprises a vertical strap attached by a ring structure to a horizontal strap and wherein the at least one shoe-attachable foot further comprises an attachment structure located on a bottom surface of the at least one shoe-attachable foot.

* * * * *